US005085595A

United States Patent [19]

Koegel et al.

[11] Patent Number: 5,085,595

[45] Date of Patent: Feb. 4, 1992

[54] SIDE ENTRY CABLE ASSEMBLY

[75] Inventors: Keith S. Koegel, Linglestown; Ronald M. Weber, Lebanon, both of Pa.

[73] Assignee: AMP Incorporated, Harrisburg, Pa.

[21] Appl. No.: 681,215

[22] Filed: Apr. 5, 1991

[51] Int. Cl.[5] ..... H01R 9/07

[52] U.S. Cl. ..... 439/494; 439/497

[58] Field of Search ..... 439/492–499, 439/92, 101, 108, 936, 736, 686, 695, 696, 701; 29/858, 860, 867

[56] References Cited

U.S. PATENT DOCUMENTS

| | | | |
|---|---|---|---|
| 4,040,704 | 8/1977 | Huber | 339/99 R |
| 4,083,615 | 4/1978 | Volinskie | 339/17 F |
| 4,094,566 | 6/1978 | Dola et al. | 339/14 R |
| 4,140,360 | 2/1979 | Huber | 339/176 MF |
| 4,178,051 | 12/1979 | Kocker et al. | 339/45 M |
| 4,260,209 | 4/1981 | Zell et al. | 339/14 R |
| 4,269,466 | 5/1981 | Huber | 339/107 |
| 4,279,074 | 7/1981 | Zell et al. | 29/866 |
| 4,310,208 | 1/1982 | Webster et al. | 339/14 R |
| 4,379,361 | 4/1983 | Webster et al. | 29/857 |
| 4,579,404 | 4/1986 | Lockard | 339/14 R |
| 4,596,428 | 6/1986 | Tengler | 339/14 R |
| 4,602,830 | 7/1986 | Lockard | 339/14 R |
| 4,602,831 | 7/1986 | Lockard | 339/14 R |
| 4,655,515 | 4/1987 | Hamsher, Jr. et al. | 339/14 R |
| 4,681,382 | 7/1987 | Lockard | 439/92 |
| 4,682,840 | 7/1987 | Lockard | 439/874 |
| 4,737,117 | 4/1988 | Lockard | 439/92 |
| 4,781,620 | 11/1988 | Tengler et al. | 439/497 |
| 4,834,674 | 5/1989 | Beamenderfer et al. | 439/494 |
| 4,846,726 | 7/1989 | Pala | 439/492 |
| 4,865,562 | 9/1989 | Burg et al. | 439/736 |
| 4,875,877 | 10/1989 | Fleak et al. | 439/497 |
| 4,880,388 | 11/1989 | Beamenderfer et al. | 439/108 |
| 4,973,264 | 11/1990 | Kamono et al. | 439/736 |
| 4,993,969 | 2/1991 | Cabourne | 439/498 |
| 5,009,614 | 4/1991 | Fogg et al. | 439/497 |
| 5,009,616 | 4/1991 | Fogg et al. | 439/936 |

*Primary Examiner*—David L. Pirlot
*Attorney, Agent, or Firm*—Gerald K. Kita

[57] ABSTRACT

An electrical cable assembly comprises, an insulative housing block (8) having a contact receiving side (15), a series of wire receiving channels (11) in the housing block (8), electrical contacts (9) on the housing block (8) being intercepted by alternate channels (11), another row of electrical contacts (9) separate from the housing block (8) being held along the contact receiving side (15), and being intercepted by alternate channels (11), and a cut (20) in an electrical cable (2) to offset cable wires (4) aligned by the channels (11).

12 Claims, 5 Drawing Sheets

SIDE ENTRY CABLE ASSEMBLY

FIELD OF THE INVENTION

The specification discloses an electrical cable assembly wherein ground wires of an electrical cable are connected to a ground bus, and the cable enters a cable entry side of the cable assembly.

BACKGROUND OF THE INVENTION

According to U.S. Pat. 4,834,674, a known electrical cable assembly comprises, electrical contacts mounted in an insulative housing, the contacts are connected to signal wires of an electrical cable, a ground bus is connected to ground wires of the cable, the ground bus is connected to selected contacts, and the wires are bent to extend toward a cable entry side of the cable assembly. Fluid plastic material is cast in place to fill open spaces between the wires, and to cover open ends of contact receiving cavities of a housing.

The plastic material solidifies to form a rear surface of the insulative housing which can be held onto by latches of a header, such as the header disclosed in U.S. Pat. No. 4,178,051. To extend the wires toward a cable entry side is desirable, for example, to provide a copious area on the rear surface of the insulative housing for engagement by the latches.

SUMMARY OF THE INVENTION

The invention is directed to a technique for extending wires of a cable toward a cable entry side of an insulating housing. According to the invention, an offset bend in an electrical cable is facilitated by a cut in a jacket of the cable across the lengths of the cable wires. The cut enables bending the cable wires at the cut to provide the offset bend. Subsequently the cut is imbedded in insulative plastic material for insulation and for protection. The plastic material is solidified to form a rigid housing end, the surface of which is suitable for engagement by latches of a header. The offset bend extends the cable toward a cable entry side instead of toward the rigid end of the housing.

The invention resides in a cable assembly that comprises, an insulative housing block having a contact receiving side, a series of wire receiving slots in the housing block communicating with the contact receiving side, wire connecting portions of corresponding multiple electrical contacts being intercepted by alternate slots of the series of slots, and a row of electrical contacts separate from the housing block held along the contact receiving side in alignment with corresponding alternate slots of the series of slots.

DETAILED DESCRIPTION

Figure 1:
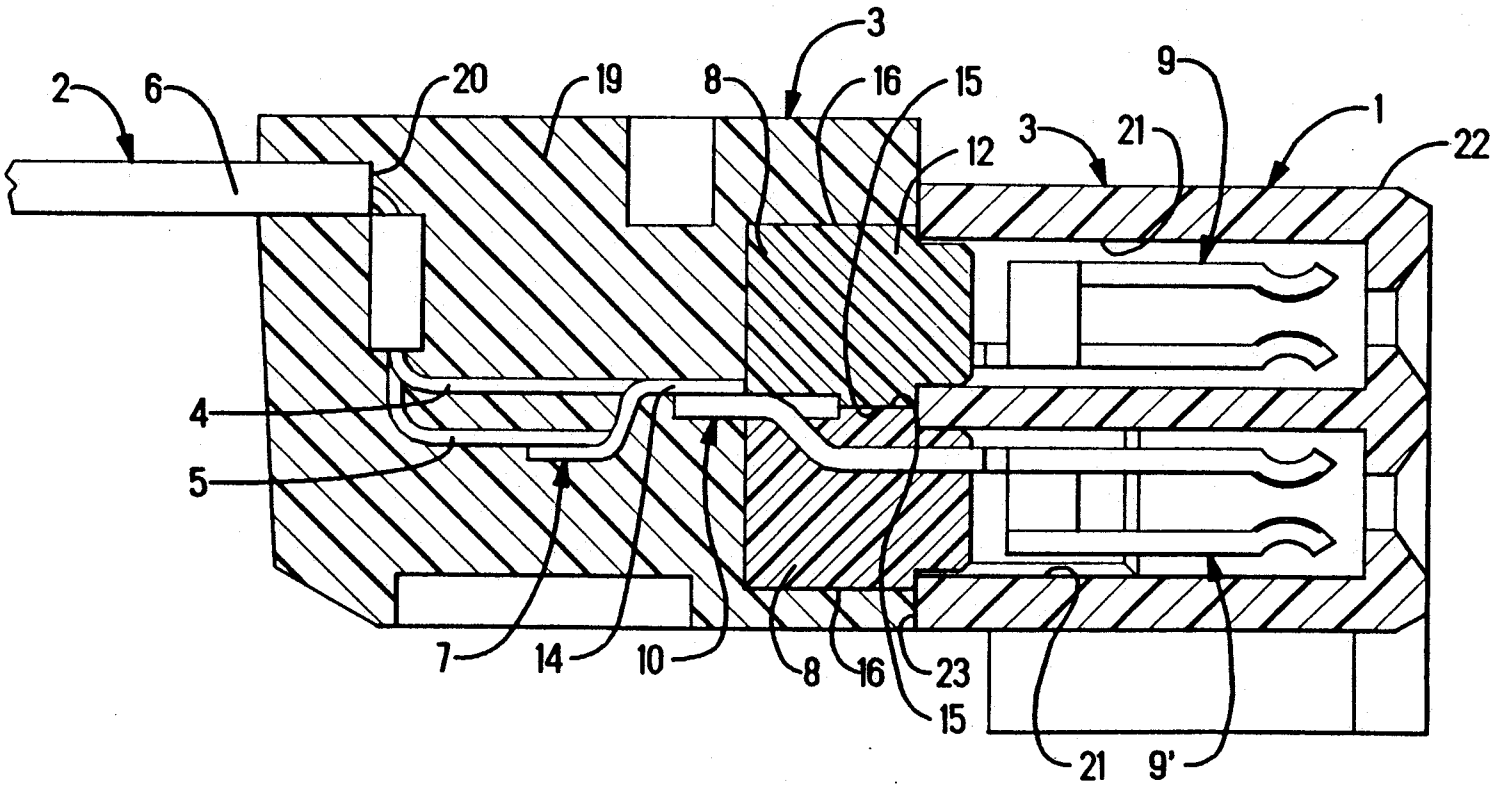
FIG. 1 is an enlarged, fragmentary section view of a cable assembly.
Figure 6:
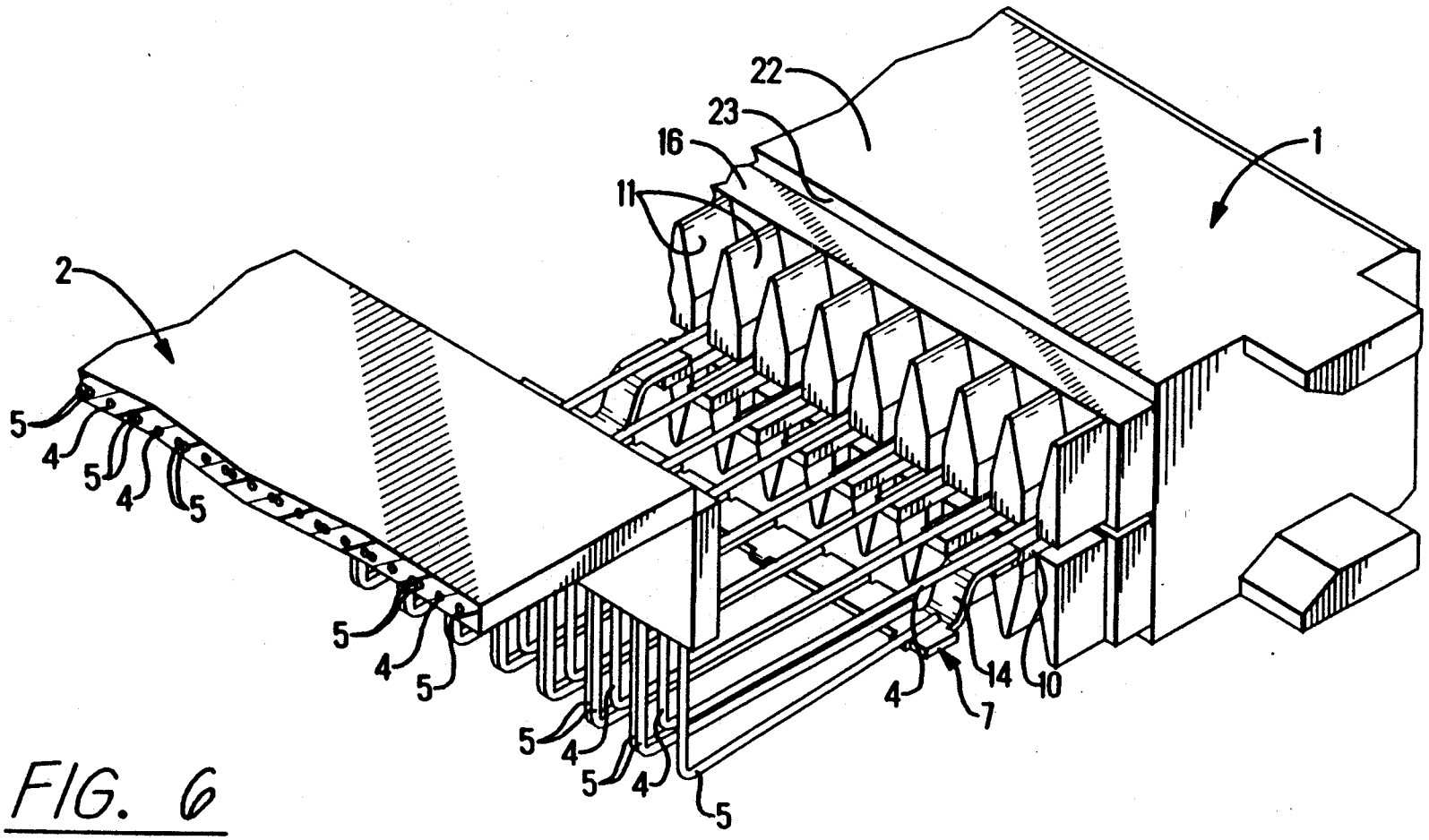
FIG. 6 is a fragmentary perspective view of a bent electrical cable and a housing assembled with the structure shown in FIG. 5.

With further reference to FIGS. 1 and 6, an electrical cable assembly 1 comprises, an electrical cable 2 connected at its corresponding end with an electrical connector assembly 3. The cable 2, shown in FIGS. 1 and 6–8, includes parallel elongated signal wires 4 spaced apart from each other on a pitch spacing, and parallel elongated ground wires 5, spaced apart from each other on a pitch spacing. The ground wires 5 are provided for connection to a reference electrical potential known collectively as ground potential. The signal wires 4 are provided for transmitting electrical signals, except for one or more of the signal wires 4 that are selected for connection to ground potential. The wires 4,5 are arranged in an order such that each signal wire 4 is between a pair of ground wires 5, and the wires 4, 5 are coplanar and spaced apart from each other. A planar and bendable jacket 6 of insulative material encircles each of the wires 4, 5. The order of the wires 4, 5 and their distances apart from each other, and the dielectric properties of the jacket 6 are unvaried along the length of the cable 2 such that a characteristic impedance of the cable 2 is maintained throughout its length.

The electrical connector assembly 3 comprises, a conductive ground bus 7 for connection to corresponding ground wires 5 projecting from the cable jacket 6, an insulative housing block 8, and conductive electrical contacts 9 having corresponding wire connecting portions 10 for connection to corresponding signal wires 4 projecting from the cable jacket 6.

The housing block 8 is fabricated of plastics material that is injection molded onto a coplanar row of the wire connecting portions 10 of the contacts 9. The housing block 8 includes a series of wire aligning channels 11 with tapered sides to funnel corresponding signal wires 4 onto corresponding wire connecting portions 10 aligned with corresponding channels 11. The housing block 8 has profiled front plugs 12 in front of a monolithic central portion 13. The channels 11 extend from a rear of the housing block 8 to the central portion 13.

The ground bus 7 is of unitary metal construction and provides conductive, spaced apart tabs 14 that are in a row and in a corresponding plane. The tabs 14 are spaced apart with a pitch spacing correspondingly the same as the pitch spacing of the spaced apart wire connecting portions 10 of the contacts 9.

Figure 3:
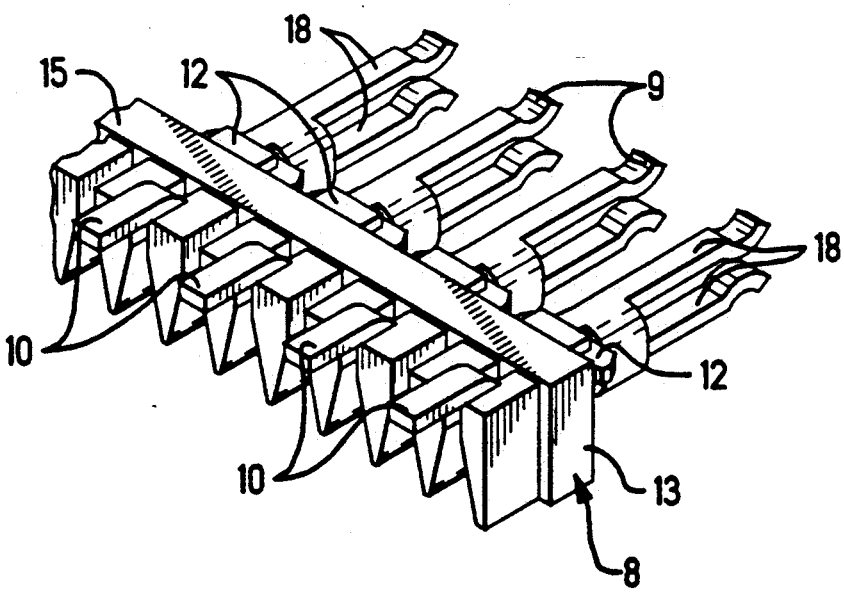
FIG. 3 is a perspective view of an inverted housing block and multiple contacts of the cable assembly shown in FIG. 1.
Figure 4:
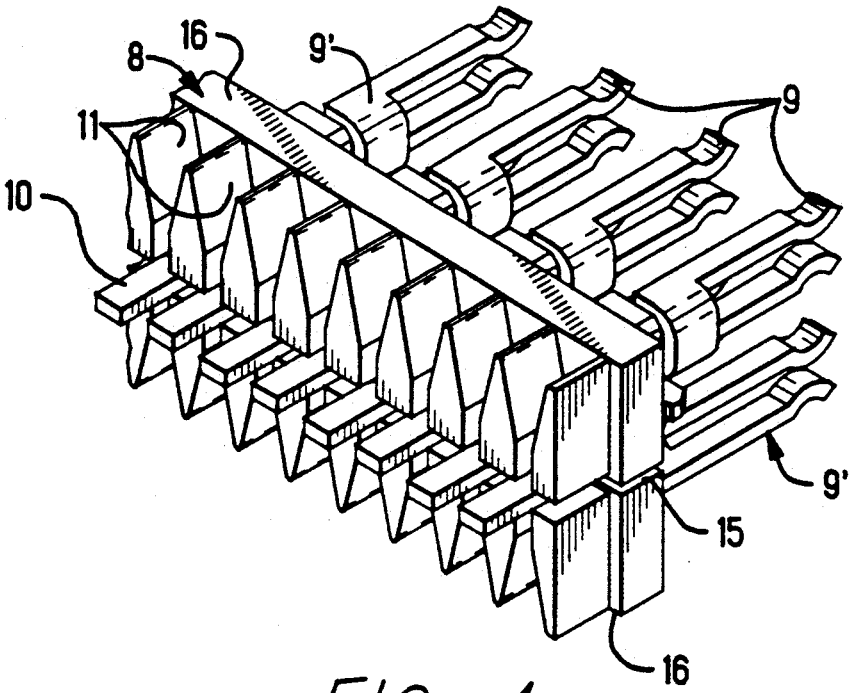
FIG. 4 is a perspective view of the housing block and contents shown in FIG. 3, stacked together with a duplicate of the housing block and contacts.
Figure 5:
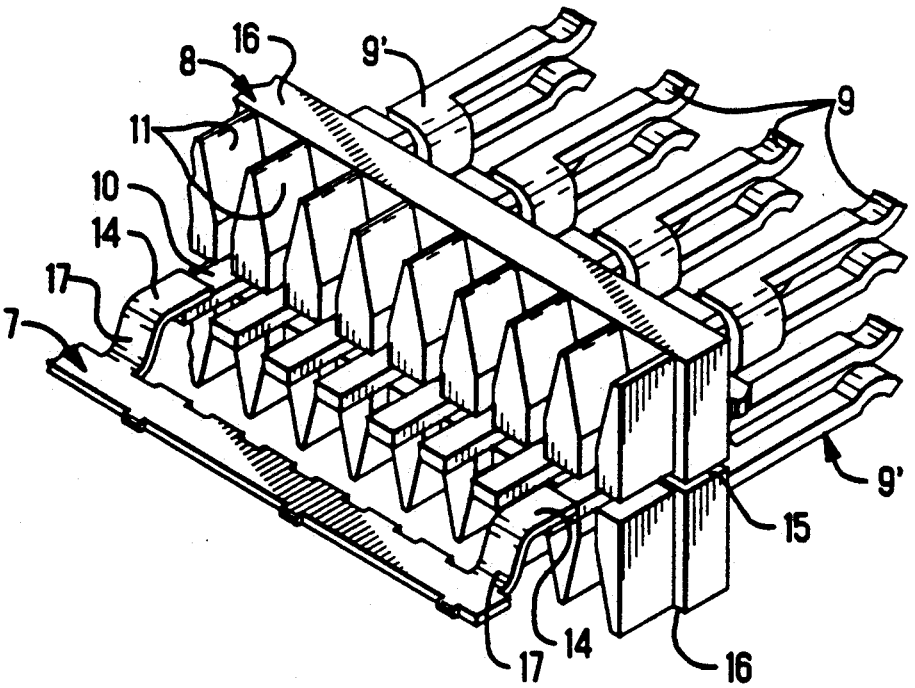
FIG. 5 is a view similar to FIG. 4 and adding a ground bus.

With reference to FIGS. 3, 4 and 5, assembly of the ground bus 7 in the connector assembly 3 will be described. One or more of the contacts 9 are selected as ground contacts 9' to connect the ground bus 7 to ground potential. Selected tabs 14 are removed from the ground bus 7. Other selected tabs 14 that remain connected to the ground bus 7 are placed to overlie the wire connecting portions 10 of the ground contacts 9'. The tabs 14 are connected to the wire connecting portions 10 of the ground contacts 9', for example by welding or soldering, such that the ground contacts 9' are connected to the ground bus 7.

Each housing block 8 has a contact receiving side 15 and an opposite side 16. The series of wire receiving channels 11 intercept and communicate with the contact receiving side 15. The wire connecting portions 10 of the contacts 9 are intercepted by alternate ones of the channels 11. Other alternate ones of the channels 11 intercept spaces between adjacent contacts 9. Another row of contacts 9, separate from the first row of contacts 9, are carried by a second, duplicate housing block 8, and are held along the contact receiving side 15 of the first housing block 8 by a contact receiving side 15 of the second housing block 8. The wire connecting portions 10 of the contacts 9 emerge from the corresponding side 15 and are coplanar along a recessed portion of the corresponding side 15. The recessed portion is recessed to a depth of one-half of the common thicknesses of the wire connecting portions 10, such that when the two housing blocks 8 meet along their sides 15, the wire connecting portions 10 are received in the recessed portions of both housing blocks 8. The wire connecting portions 10 of each housing block 8 are in a row with, and alternate in coplanar series with, the wire connecting portions 10 of the other housing block 8. The wire connecting portions 10 of said another row of contacts 9 are intercepted by said other alternate channels 11 that intercept spaces between adjacent contacts 9 of the first housing block 8. The second housing block 8 has a series of wire receiving channels 11 that intercept the wire connecting portions 10 of alternating contacts 9 of both rows of contacts 9 that are between the contact blocks 8. The signal wires 5 extend along the wire aligning channels 11 of one or, alternately, the other, of the housing blocks 8, for connection to the contacts 9 of both housing blocks 8.

The wire connecting portion 10 of each contact is in the form of an axially extending strip or tab projecting to the rear from the central portion 13 of the housing block 8. The wire connecting portions 10 of the contacts 9 are strips of narrow widths to allow welding individual contact portions 10 to corresponding signal wires 4.

The wire connecting portions 10 are spaced apart on a pitch spacing correspondingly the same as the pitch spacing of the spaced apart signal wires 4. The signal wires 4 are cut to a common length, simultaneously overlaid upon the coplanar wire connecting portions 10 of the contacts 9 and are connected to the wire connecting portions 10 in one joining operation, for example, by welding or soldering. Wire connections of the signal wires 4 are formed by the joining operation. Opposite sides of the wire connecting portions 10 are exposed to permit clamping of the wire connecting portions 10 between a pair of conventional electrodes, not shown, used for welding or soldering. Further the opposite sides of the wire connecting portions 10 are exposed to facilitate connection of a corresponding tab 14 selectively to one of the sides. Each of the tabs 14 has an offset portion 17, FIG. 5, to offset the bus bar 7 from the plane of the wire connecting portions 10 of the contacts 9.

Figure 2:
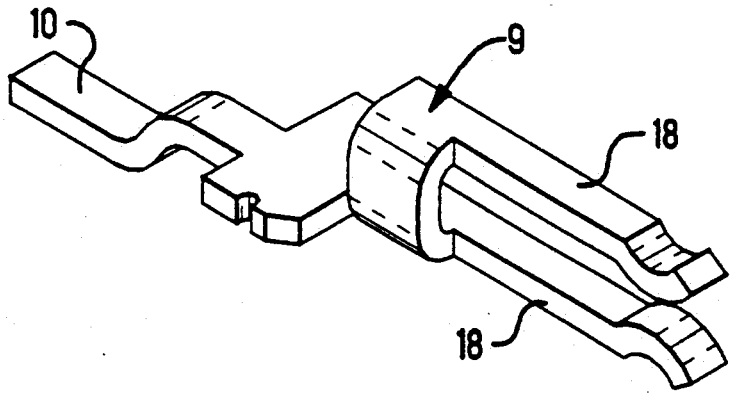
FIG. 2 is a perspective view of an electrical contact of the cable assembly shown in FIG. 1.

As shown in FIG. 2, each contact 9 is of unitary construction and includes a pair of spaced apart fingers 18 defining an electrical receptacle portion open at a front end of the contact 9. The axis of the receptacle portion is offset from the plane of the wire connecting portion 10 to define two rows of electrical receptacle portions at fronts of the housing blocks 8 and one row of alternating wire connecting portions 10 at rears of the housing blocks 8.

As shown in FIGS. 1 and 5, the ground bus 7 is of strip configuration. The strip configuration extends transversely of the housing 8 and provides wire connecting portions thereon to which corresponding ground wires 5 are connected. The ground wires 5 are cut to a common length, are simultaneously overlaid upon the coplanar wire connecting portions of the ground bus 7 and are connected to the wire connecting portions in one joining operation, for example, by welding or soldering. Wire connections of the ground wires 5 are formed by the joining operation.

Opposite sides of the wire connecting portions of the ground bus 7 are exposed, and thereby permit clamping of the wire connecting portions between a pair of conventional electrodes, not shown, to be used for welding or soldering the ground wires 5 to the ground bus 7.

With reference to FIG. 6, a signal wire 4 and a tab 14 are connected to the same wire connecting portion 10 of at least one corresponding ground contact 9', and further are connected to each other, by the joining operation. The signal wire 4 is placed to overlie both the tab 14 and the wire connecting portion 10 and is simultaneously connected thereto by the joining operation. Thereby, the signal wire 4 is selected to conduct the ground potential along the cable 2.

Before the ground wires 5 are connected to the ground bus 7 of a connector assembly 3, and the signal wires 4 and the tabs 14 are connected to a corresponding ground contact 9' of the connector assembly, an offset bend is provided in the cable.

Figure 7:
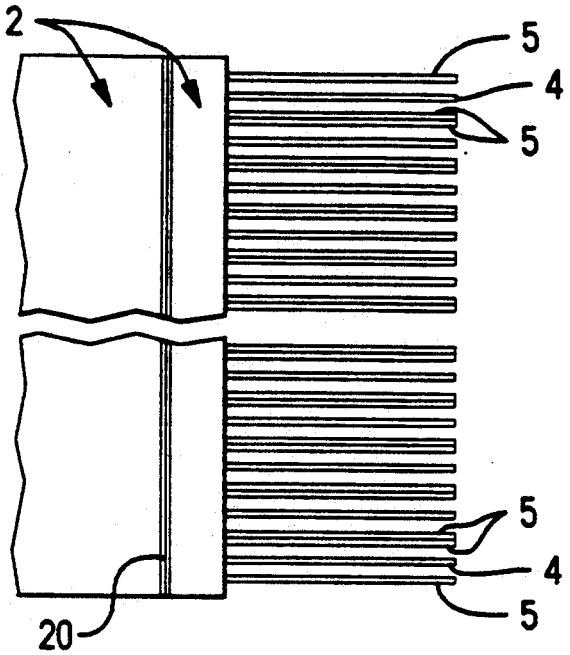
FIG. 7 is a fragmentary plan view of the cable shown in FIG. 6, prior to the cable being bent.
Figure 8:
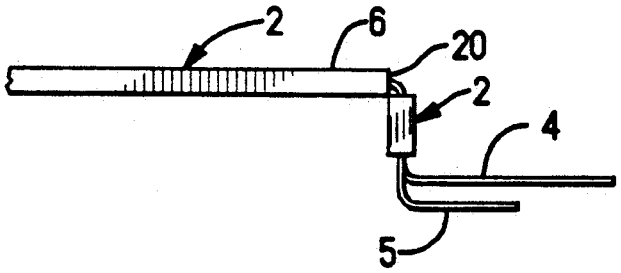
FIG. 8 is an elevation view of the cable shown in FIG. 7, after the cable has been bent.

With reference to FIGS. 7 and 8, the wires 4, 5 project from a front end of the cable jacket 6. A cut 20 is provided in the jacket 6 transverse to the wires 4, 5 to define a location for bends in the wires 4, 5, and a location for bending the jacket 6 in a hinge like manner along the cut 20. The projecting wires 4, 5 are then bent where they emerge from the jacket 6 to extend in respective planes for corresponding connection to the contacts 9 and the ground bus 7.

After the wires 4, 5 are bent and connected to the contacts 9 and the ground bus 7, fluid and insulative material, such as plastic material 19 is cast in place to fill the channels 11 and the spaces between the wires 4, 5, and to cover the wires 4, 5 and the wire connecting portions 10 of the contacts 9 and the ground bus 7 and the cut portion of the jacket 6 of the cable 2, and to imbed the cable 2 along a cut area defined on both sides of the cut 20. The contacts 9 have been received in corresponding contact receiving cavities 21 of an insulative housing 22. The profiled plugs 12 enter and plug the profiles of corresponding contact receiving cavities 21, thereby to prevent ingress of the fluid material 19. The central portion 13 covers the ends of the cavities 21. Thereafter, the plastic material 19 is solidified to adhere to the housing 22, and fix the wires 4,5 in place. The plastic material 19 embeds and adheres to an embedded end portion of the jacket 6. The solidified plastic material 19 forms a rigid, rear end 23 of the housing 22, which can be held onto by latches of a header, for example, as disclosed in U.S. Pat. No. 4,178,051. The plastic material 19 retains the embedded portion of the cable 2 toward a cable entry side of the housing 22 instead of centrally through the end 23 of the housing 22. The offset bend in the cable 2 extends the cable toward a cable entry side instead of toward the central portion of the end 23 of the housing 22.

We claim:

1. An electrical cable assembly comprising: first and second insulative housing blocks, each housing block having a contact receiving side, a series of wire receiving channels in the housing block communicating with the contact receiving side, multiple electrical contacts on the housing block being intercepted by alternate channels of the series of channels, other alternate channels of the series of channels intercepting spaces between adjacent contacts, the housing blocks meet such that the contacts of one of the housing blocks are intercepted by the other alternate channels of the other of the housing blocks, and wires of at least one electrical cable being aligned along corresponding channels of at least one or the other of said housing blocks for attachment to corresponding electrical contacts intercepted by said corresponding channels.

2. An electrical cable assembly as recited in claim 1 wherein, the wire receiving channels and the cable are imbedded in insulative material.

3. An electrical cable assembly as recited in claim 1 wherein, a ground bus is connected to at least one selected contact, and insulative material covers the ground bus.

4. An electrical cable assembly as recited in claim 1 wherein, coplanar wire connecting portions of the contacts are intercepted by said channels, and the wire connecting portions are between the housing blocks.

5. An electrical connector assembly as recited in claim 1 wherein, a ground bus is connected to at least one of the contacts and is offset to project to the rear of one of the housing blocks, and an offset bend in the cable extends the cable to project from the rear of the other of the housing blocks.

6. An electrical connector assembly as recited in claim 1 wherein, the wires are bent along a cut in a jacket of the cable, the jacket is bent in a hinge like manner along the cut, and insulative material covers the cut.

7. An electrical cable assembly as recited in claim 1 wherein, contact receiving cavities of an insulative housing receive portions of the contacts, and the housing blocks cover ends of the cavities.

8. An electrical cable assembly as recited in claim 7 wherein, insulative material covers the wires projecting from a remainder of the cable, and fills the channels of the housing blocks.

9. A method for constructing a cable assembly comprising the steps of:

assembling first and second rows of electrical contacts on respective first and second insulative housing blocks having wire receiving channels, alternate ones of said channels of the respective housing blocks intercepting adjacent contacts, and other alternate ones of said channels of the respective housing blocks intercepting spaces between adjacent contacts, assembling the housing blocks together with the contacts of each housing block being intercepted by said other alternate ones of the channels of the other housing block, assembling wires of at least one electrical cable along respective channels of either one or the other of said housing blocks, and connecting said wires to respective contacts of both rows intercepted by the respective channels.

10. A method as recited in claim 9, and further comprising the step of: holding said contacts against contact receiving sides of both said housings.

11. A method as recited in claim 9, and further comprising the step of: cutting an insulative jacket of the cable to define a location for bends in the wires, bending the wires along the location to orient the cable to a cable entry location, and covering a cut area of the cable with insulative material.

12. A method as recited in claim 9, and further including the step of: bending a jacket of the cable in a hinge like manner along a cut in the jacket, and covering the cable along the cut with insulative material to hold the cable in a bend.

* * * * *